US005628122A

United States Patent [19]

Spinardi

[11] Patent Number: 5,628,122

[45] Date of Patent: May 13, 1997

[54] LINT REMOVER FOR A CLOTHES DRYING MACHINE

[75] Inventor: Theodore J. Spinardi, Shingle Springs, Calif.

[73] Assignee: Peter and Theordore Spinardi Investments, Shingle Springs, Calif.

[21] Appl. No.: 318,067

[22] Filed: Oct. 5, 1994

[51] Int. Cl.[6] ..... F26B 21/06

[52] U.S. Cl. ..... 34/79; 34/75; 55/244; 137/132

[58] Field of Search ..... 34/75–79, 90, 34/82, 85, 86, 72, 318, 83; 55/244, 249; 261/119.1; 137/132

[56] References Cited

U.S. PATENT DOCUMENTS

| | | | |
|---|---|---|---|
| 1,530,073 | 3/1925 | Cutter | 34/79 |
| 2,391,006 | 12/1945 | Bryce et al. | 137/132 |
| 2,720,037 | 10/1955 | Erickson | 34/45 |
| 2,825,148 | 3/1958 | Olson | 34/75 |
| 2,838,845 | 6/1958 | Erickson | 34/45 |
| 2,910,854 | 11/1959 | Hughes | 34/79 |
| 2,959,044 | 11/1960 | Stone | 34/79 |
| 3,132,005 | 5/1964 | McMillan | 34/54 |
| 4,498,247 | 2/1985 | Benevento | 34/82 |
| 4,874,404 | 10/1989 | Boswell | 55/86 |
| 4,969,276 | 11/1990 | Walsh | 34/90 |

FOREIGN PATENT DOCUMENTS

| | | | |
|---|---|---|---|
| 1098364 | 7/1955 | France | 55/244 |

*Primary Examiner*—James C. Yeung
*Attorney, Agent, or Firm*—Bernhard Kreten

[57] ABSTRACT

A lint remover 10 is provided for removing lint from an air exhaust of a clothes dryer D. An enclosure 20 includes an inflow tube 60 delivering water into the enclosure 20. The inflow tube 60 is coupled to a clothes washer W used water discharge. The enclosure 20 includes a suction passage 80 which is oriented to utilize gravity to suck water within the enclosure 20 out through the suction passage 80, through an outflow tube 90 and into a water drainage system WD. The suction passage 80 is configured to always provide a pool P with a surface S within the enclosure 20. An inlet duct 40 directs dryer D exhaust air from the dryer D into the enclosure 20. An inlet vane 32 directs this dryer D exhaust air against the surface S of the pool P, causing lint within the dryer D exhaust air to be deposited within the pool P. An outlet duct 50 draws the dryer D exhaust air out of the enclosure 20. The pool P is refreshed with replacement water within the enclosure 20 every time the washer W drains water. Thus, the dryer D is always provided with a relatively clean surface S of water for deposition of lint thereinto.

22 Claims, 4 Drawing Sheets

LINT REMOVER FOR A CLOTHES DRYING MACHINE

FIELD OF THE INVENTION

The following invention relates to devices for the removal of lint from clothes dryer exhausts. More specifically, this invention is related to lint-removal systems which utilize water, especially from a discharge of a clothes washing machine, to remove lint from a clothes dryer air exhaust.

BACKGROUND OF THE INVENTION

In the clothes washing process, hot air clothes dryers have become the primary method by which clothes are dried. The clothes dryer typically includes a rotating barrel which tumbles the clothes while elevated temperature air is passed through the barrel. The clothes therein are dried by evaporation of the water into the hot air stream. During this clothes drying process, conditions are ideal for the formation of lint. While lint can include a multitude of components, it is generally composed of miniscule fabric portions which become disassociated from the clothing during the washing and drying process. These lint particles are sufficiently light that they become readily airborne and are carried out of the barrel of the dryer along with the air exhaust.

Lint is a source of continuing problems for clothes drying machines. The lint is capable of adhering to exhaust conduits which direct exhaust air from the dryer to an outside environment. Once outside, they litter the environment and create a disposal problem. Also, the lint can accumulate in sufficient amounts along these exhaust passageways, to block somewhat a flow of air exhausting from the dryer, decreasing an efficiency of dryer operation.

To remedy this lint accumulation problem, it is known in the art to provide a fine mesh screen lint trap which can then be subjected to periodic cleanings. While the lint trap does effectively remove lint from the air exhaust of the dryer, it can only function properly when a user frequently cleans the lint trap. Absent these regular cleanings, the problem of lint accumulation is merely relocated from exhaust conduits of the dryer to accumulation at the lint trap. Dryer performance and potential for fire are suspected to result from excessive lint accumulation within the lint trap.

Accordingly, a need exists for an automatic system which removes lint from the dryer air exhaust in an effective manner without requiring that a user monitor the lint removal system.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| PATENT NO. | ISSUE DATE | INVENTOR |
|---|---|---|
| 2,720,037 | October 11, 1955 | Erickson |
| 2,825,148 | March 4, 1958 | Olson |
| 2,838,845 | June 17, 1958 | Erickson |
| 3,132,005 | May 5, 1964 | McMillan |
| 4,498,247 | February 12, 1985 | Benevento |
| 4,874,404 | October 17, 1989 | Boswell |
| 4,969,276 | November 13, 1990 | Walsh |

The patents to Erickson and McMillan each teach clothes dryer systems for condensing liquids from clothes dryer air exhaust and removal of lint therefrom using a liquid spray system. The clothes dryer exhaust is channeled through a region having a cold liquid spray, decreasing the temperature of the air exhaust and screening lint from the air exhaust. The present invention is distinguishable from the systems taught by Erickson and McMillan in that, inter alia, it eliminates the need for a spraying apparatus, and utilizes used washing machine water, readily available at the clothes washing site, to collect the lint from the clothes dryer exhaust.

The patent to Walsh teaches a clothes dryer/filter/humidifier which passes dryer exhaust over a static reservoir of liquid. The present invention is distinguishable from Walsh in that, inter alia, a system is provided for automatic removal and replenishment of the water utilized to entrain the lint therein.

The patent to Benevento teaches a vent for a clothes dryer which facilitates discharge of dryer exhaust air indoors. The present invention is distinguishable from Benevento in that, inter alia, a lint removal system is provided which includes a pool of water adjacent the dryer exhaust.

The remainder of the prior art cited above but not specifically distinguished diverge even more starkly from the present invention than do those prior art references specifically distinguished above.

SUMMARY OF THE INVENTION

The lint remover of this invention includes an enclosure having a floor which supports a pool of liquid thereon against which the clothes dryer exhaust is directed. The enclosure includes an orifice for receiving an inlet duct coupled to a dryer air exhaust. An opening is provided spaced from the orifice which couples to an outlet duct directing air out of the enclosure. An entrance hole passes into the enclosure and couples to an inflow tube which receives used water from a clothes washing machine. A suction passage and outflow tube extend out of the enclosure and draw liquid and lint entrained therein out of the enclosure.

The enclosure can be mounted on a wall adjacent a clothes washing machine and a clothes drying machine, framed into a building adjacent where hookups are provided for a clothes washing machine and a clothes drying machine, incorporated into a clothes washing machine or incorporated into a clothes drying machine. The enclosure remains filled with liquid from the washing machine regardless of whether the washing machine is operating or not. When the washing machine is not delivering used water to the enclosure, the liquid within the enclosure is static. When the washing machine is directing used water to the enclosure, liquid within the enclosure is dynamic, both flowing into and out of the enclosure. During either static or dynamic operation of the lint remover, clothes dryer air exhaust can be passed through the enclosure for lint removal.

By using the used water from a clothes washing machine to collect lint, the enclosure is simultaneously automatically cleaned during the washing machine operation cycle. Detergents in the used washing machine water can cleanse surfaces of the enclosure. The washer typically discharges large amounts of water during each cycle. Thus, a ratio of water to lint exiting the dryer is very large.

OBJECTS OF THE INVENTION

Accordingly, it is a primary object of the present invention to provide a lint remover for air exhaust from a clothes dryer which utilizes used water from a clothes washing machine to entrain and remove lint from the clothes dryer air exhaust.

Another object of the present invention is to provide a device for automatically removing lint from a clothes dryer air exhaust, which does not require periodic cleaning or maintenance.

Another object of the present invention is to provide a lint remover which either replaces or minimizes the need for a lint trap in a clothes drying machine.

Another object of the present invention is to provide a useful secondary purpose for used clothes washing machine liquid discharge, by utilizing the used liquid discharge to capture lint from a clothes drying machine air exhaust.

Another object of the present invention is to enhance an efficiency of a clothes drying machine by eliminating the possibility of excessive lint collection on a screen trap.

Another object of the present invention is to improve a safety of a clothes drying machine by automatically removing lint from the air exhaust of the clothes drying machine, such that the lint is not available to initiate a combustion process.

Another object of the present invention is to provide an enclosure including a pool of liquid therein which is never completely drained and is frequently refreshed with new liquid, in an automatic fashion.

Another object of the present invention is to provide an enclosure supporting liquid therein and including a suctioning means to rapidly and effectively evacuate liquid and lint entrained therein from within the enclosure.

Another object of the present invention is to provide a lint removing device which is easily connected to existing consumer appliances.

Another object of the present invention is to provide a lint remover which is of lightweight durable construction and which facilitates simple manufacture from readily available materials.

Viewed from a first vantage point, it is an object of this invention to provide an apparatus for washing lint from a clothes drying machine air exhaust, comprised of an enclosure, a liquid inflow tube receiving liquid from a liquid source and coupled to the enclosure, an air inlet duct including means to connect to a clothes drying machine air exhaust and coupled to the enclosure, the enclosure also including an air outlet duct and a liquid outflow tube, the liquid outflow tube oriented in fluid communication with the liquid inflow tube such that a pool of liquid is provided within the enclosure, the pool of liquid oriented proximate to the air inlet duct, such that lint entrained within air exiting the air inlet duct and into the enclosure is brought into contact with the pool of liquid.

Viewed from a second vantage point, it is an object of this invention to provide a method for removing lint from a clothes dryer air exhaust, including the steps of: scavenging dryer air from a clothes dryer exhaust including lint entrained therein, providing a liquid, directing the dryer air against the liquid to entrain the lint within the liquid, and providing an outflow in fluid communication with the liquid to remove the liquid and lint entrained in the liquid.

Viewed from a third vantage point, it is an object of this invention to provide a clothes washing system comprised of a clothes washing machine including means to wash clothes with water and a used water outlet, a clothes drying machine including means to dry clothes with air and an air exhaust, and an air exhaust lint removal system including an air inlet having a means to receive the air exhaust from the clothes drying machine, and air outlet for releasing air to the environment, a water inflow tube including means to receive the used water from the used water outlet of the clothes washing machine and a means to output water and lint into a liquid waste system.

These and other objects will be made manifest when considering the following detailed specification when taken in conjunction with the appended drawing figures.

DESCRIPTION OF PREFERRED EMBODIMENTS

Figure 1:
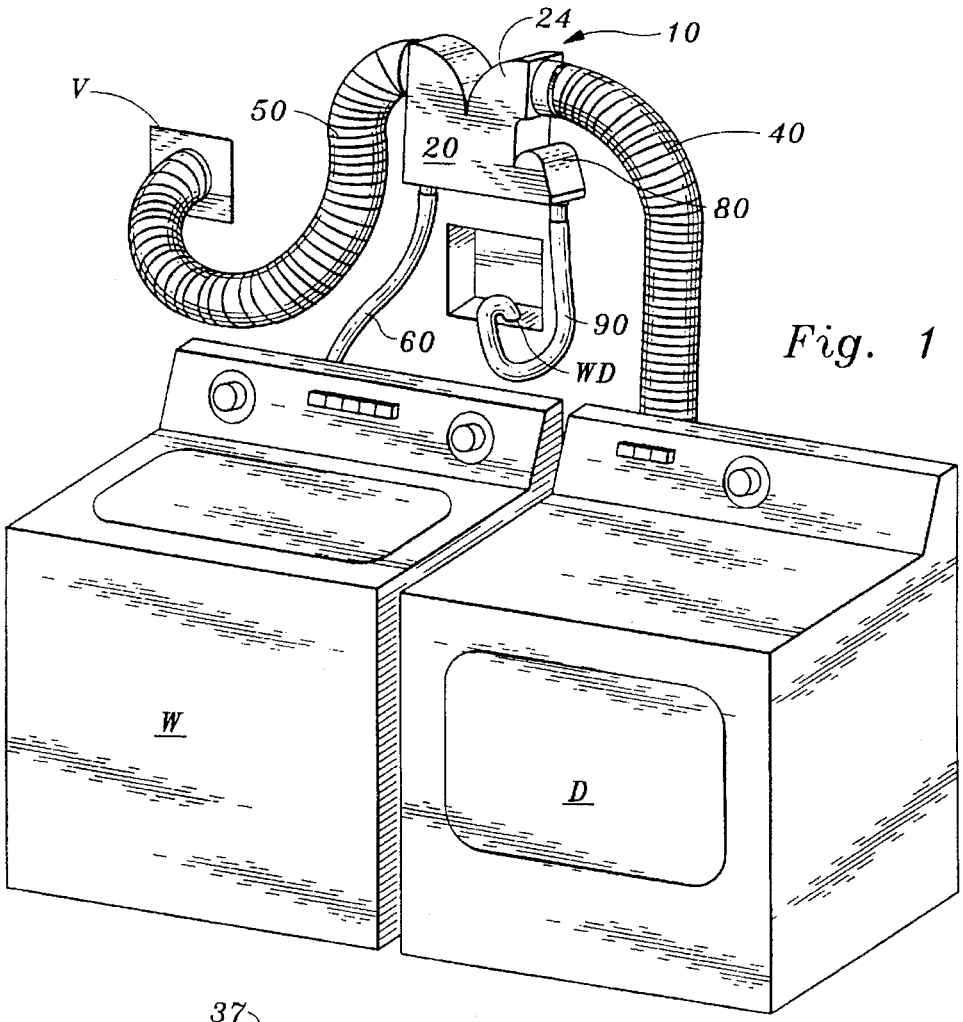
FIG. 1 is a perspective view of the lint remover of this invention coupled to a clothes washer and a clothes dryer in a manner prepared for operation thereof to remove lint from the air exhaust of the dryer.

Referring to the drawings, wherein like reference numerals represent like parts throughout the various drawing figures, reference numeral 10 (FIG. 1) is directed to a lint removal system for a clothes drying machine. The lint remover 10 includes an enclosure 20 which supports a pool P (FIG. 3) of liquid having a surface S which collects lint from air exiting a clothes dryer D.

Figure 2:
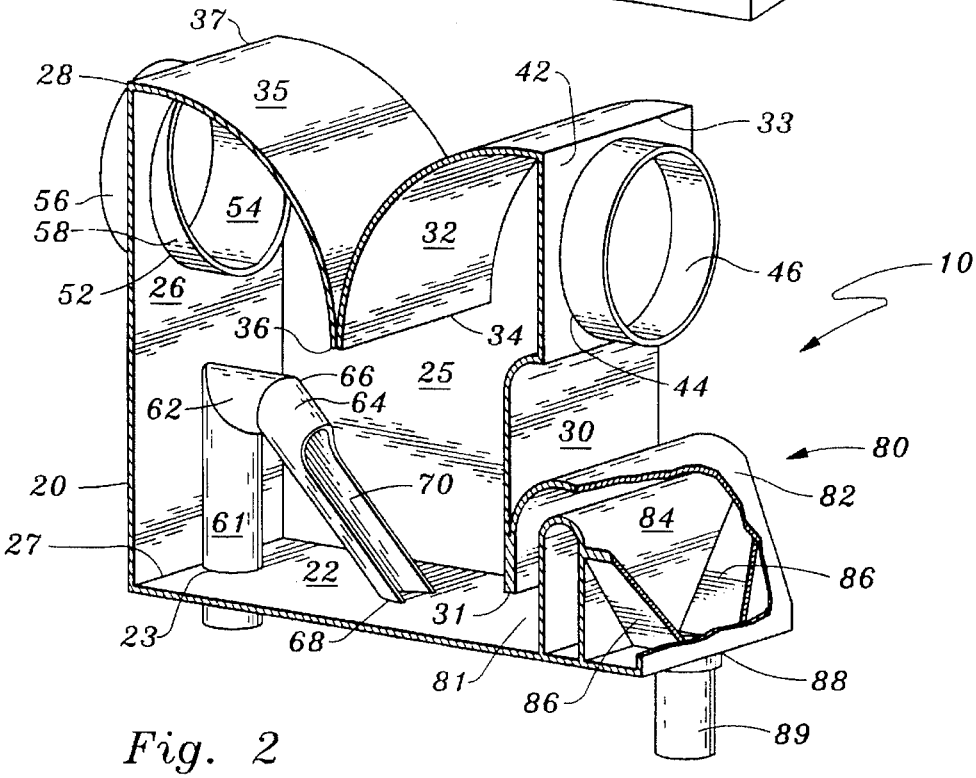
FIG. 2 is a perspective view of an enclosure portion of that which is shown in FIG. 1 with portions of the exterior thereof removed to reveal interior details.

In essence, and with reference to FIGS. 1 and 2, the lint remover 10 includes the enclosure 20 and various connections which allow the enclosure 20 to periodically receive water from a source such as used water from a clothes washer W, air exhaust from a clothes dryer D, and discharge air into the environment and water into a liquid waste disposal system. The enclosure 20 includes a floor 22 as a bottom surface thereof which supports the pool P thereon. The enclosure includes an orifice 44 supporting an inlet duct 40 connected to the dryer D air exhaust and an opening 52 supporting an outlet duct 50 which directs the air into the environment. The enclosure 20 includes an entrance hole 23 supporting an inflow tube 60 which is coupled to a used water discharge of a clothes washer W and a suction passage 80 which draws the water out of the enclosure 20 and into an outflow tube 90, directing the liquid to the liquid waste disposal system.

More specifically, and with reference to FIGS. 2 through 6, details of the enclosure 20 are shown in detail. The enclosure 20 is essentially a hollow orthorhombic container with the planar floor 22 forming a lower surface thereof. A front sidewall 24 (FIG. 1) and back sidewall 25 extend up from the floor 22 in substantially parallel planes. A first endwall 26 extends up from the floor 22 between the front sidewall 24 and back sidewall 25. A second endwall 30 is oriented parallel to and spaced from the second endwall 30 and extends up from the floor 22 between the front sidewall 24 and the back sidewall 25.

The floor 22 includes an entrance hole 23 passing therethrough which receives and supports a vertical extension 61 of the inflow tube 60 for inflow of used water from the washing machine W (FIG. 1). The front sidewall 24 (FIG. 1) and back sidewall 25 provide structural support for the enclosure 20 and support the water or other liquid forming the pool P, preventing escape of the water out of the enclosure 20 except where desired.

The first endwall 26 extends upward from a bottom edge 27 adjacent the floor 22 to a top edge 28 opposite the bottom edge 27. The second endwall 30 extends from a lower end 31 up to a wall 42 through which the orifice 44 passes to direct exhaust air from the dryer D. The second endwall 30 curves slightly adjacent the wall 42, to provide a smooth directional transition for dryer exhaust air entering the enclosure 20 from a substantially horizontal direction of travel to a vertically downward direction of travel. The lower end 31 of the second endwall 30 is spaced from the floor 22. Thus, an entrance 81 is provided to the suction passage 80 for discharge of the water out of the enclosure 20.

An upper surface of the enclosure 20 opposite the floor 22 is formed by an inlet vane 32 and an outlet vane 35. Each of the vanes 32, 35 curves to modify a flow vector of air entering and exiting the enclosure 20. The inlet vane 32 extends horizontally from an upper edge 33 adjacent the wall 42, then curves to a lower end 36 where the vane 32 is substantially vertical in orientation. The lower edge 34 is preferably intermediate in location between the first endwall 26 and second endwall 30.

The outlet vane 35 extends from a lower end 36 adjacent the lower edge 34 in a substantially vertical orientation, and then curves to the upper end 37 adjacent the top edge 28 of the first endwall 26 where the outlet vane 35 is oriented substantially horizontally. The inlet vane 32 is preferably substantially parallel to an upper portion of the second endwall 30, such that air passing through the orifice 44 and into the enclosure 20 is not constrained as it impinges against the inlet vane 32 and has its flow vector changed from a substantially horizontal orientation to a substantially vertical downward orientation.

With reference now to FIGS. 1 and 2, details of the inlet duct 40 and its connection to the enclosure 20 are described. The inlet duct 40 is coupled to and extends between an air exhaust of the clothes dryer D and the enclosure 20. Specifically, the wall 42 of the enclosure 20 is provided with an orifice 44 of substantially circular form with a collar 46 extending therefrom. The collar 46 is essentially a hollow cylinder with a central axis shorter than a diameter of the collar 46. Preferably, the inlet duct 40 overlies the collar 46 with some form of restraining belt applied to an exterior of the inlet duct 40 where the inlet duct 40 overlies the collar 46. The inlet duct 40 is held tightly against the collar 46 without allowing substantial air leakage between the inlet duct 40 and the collar 46. In this way, all of the air exiting the dryer D is directed into the enclosure 20 for removal of lint therefrom.

Preferably, the inlet duct 40 has direct access to the outlet duct 50 to prevent back pressure in the dryer D. Alternatively, however, the pool P can exhibit sufficient elevation to prevent direct access between the inlet duct 40 and the outlet duct 50. Similarly, the enclosure 20 can be configured in a variety of ways to preclude direct access between the vents 40, 50. The air exhaust from the inlet 40 would thus have a "bubble" through the liquid of pool P for more complete removal of lint therefrom.

With reference to FIGS. 1 and 2, details of the outlet duct 50 are described. The outlet duct 50 extends from the enclosure 20 to a vent V where exhaust air can be discharged into a surrounding environment. The outlet duct 50 connects to the enclosure 20 through a sleeve 54 passing through an opening 52 in the first endwall 26 of the enclosure 20. The sleeve 54 is substantially cylindrical in form with an outer cylinder 56 on an exterior of the enclosure 20 and an inner cylinder 58 on the interior of the enclosure 20. Preferably, the outer cylinder 56 extends a constant distance from the first endwall 26 around an entire perimeter of the outer cylinder 56. However, the inner cylinder 58 extends farther from the first endwall 26 at a lower portion thereof than at an upper portion thereof.

The outer cylinder 56 of the sleeve 54 preferably exhibits a diameter slightly less than a diameter of the outlet duct 50. Thus, the outlet duct 50 can overlie the outer cylinder 56 and a belt or other support can be oriented outboard of the outlet duct 50 and secure the outlet duct 50 to the outer cylinder 56 of the sleeve 54. In this way, air exiting the enclosure 20 is prevented from escaping the enclosure 20 without entering the outlet duct 50.

With reference to FIGS. 1 and 2, details of the inflow tube 60 and its delivery of used washer W water are described. The inflow tube 60 extends from a used water discharge of a washer W to the enclosure 20. At the enclosure 20, a vertical extension 61 extends through the entrance hole 23 and connects to the inflow tube 60. The vertical extension 61 is substantially a cylindrical tube of rigid construction. A lower end of the vertical extension 61 is configured to readily attach to the inflow tube 60 through any of a variety of fluid conduit connectors. The vertical extension 61 extends upwards away from the floor 22 to a location short of halfway between the floor 22 and the outlet vane 35 overlying the vertical extension 61.

The vertical extension 61 connects to a horizontal extension 62 extending substantially horizontally away from the vertical extension 61 and toward the second endwall 30. The horizontal extension 62 connects to a diagonal extension 64 which extends diagonally back toward the floor 22. The diagonal extension 64 includes a lower end 68 resting against the floor 22 and an upper end 66 which connects to the horizontal extension 62. An upper side of the diagonal extension 64 is cut away such that the diagonal extension 64 interior is exposed at a trough 70, out of which water passing therethrough can readily escape. The trough 70 is oriented on a side of the diagonal extension 64 facing the second endwall 30.

The diagonal extension 64 extends away from the horizontal extension 62 in a direction downward and towards the second endwall 30. In this way, water exiting the inflow tube 60 is directed toward the entrance 81 of the suction passage 80 which is located below the lower end 31 of the second endwall 30. Preferably, the lower end 68 of the diagonal extension 64 is oriented approximately midway between the first endwall 26 and second endwall 30.

With reference to FIGS. 1 and 2, details of the suction passage 80 and outflow tube 90 are described. The suction passage 80 removes water from within the enclosure 20 and directs the water into the outflow tube 90 which in turn delivers the water to a water drainage system WD. The suction passage 80 includes an entrance 81 adjacent the pool P, a hump 84 downstream from the entrance 81 and an exit 85 below and downstream from the hump 84. The entrance 81, hump 84 and exit 85 together define a passage for outflow of liquid such as water out of the enclosure 20. The suction passage 80 has a width similar to a width of the floor 22 at the entrance 81 and the hump 84. However, two side plates 86 cause a width of the suction passage 80 to decrease as the suction passage 80 extends from the hump 84 down to the exit 85.

A discharge hole 88 is oriented substantially coplanar with the floor 22 of the enclosure 20 but spaced away from the floor 22 by the suction passage 80. The discharge hole 88 includes a discharge cylinder 89 extending therethrough which connects to the outflow tube 90.

A hood 82 extends from the second endwall 30 at the lower end 31, up over the hump 84, and then down to a location outboard of the side plates 86 and the discharge hole 88. The hood 82 defines an upper portion of the suction passage 80 and prevents air from accessing the suction passage 80 and destroying any siphoning action occurring through the suction passage 80.

The hump 84 curves approximately 180° from extending upwards vertically, to extending downwards vertically. The hump 84 is spaced from the hood 82 by a distance sufficient to allow liquid flow through the suction passage 80 at a rate faster than liquid flow into the enclosure 20 through the inflow tube 60. The hump 84 defines a highest elevation of a lower surface of the suction passage 80.

At the highest location of the hump 84, the hump 84 is below a lowest portion of the horizontal extension 62 associated with the inflow tube 60. Thus, when water is not flowing into the enclosure 20 to the inflow tube 60, the pool P of water is drained over the hump 84 and through the suction passage 80 before water is allowed to travel backwards out of the enclosure 20 through the inflow tube 60. The trough 70 of the inflow tube 60 is cut high enough on the diagonal extension 64 to prevent any siphoning action from occurring through the inflow tube 60.

In use and operation, and with particular reference to FIGS. 3 through 6, the lint remover 10 functions in the following manner. Initially, the lint remover 10 is coupled to the washer W through the inflow tube 60, the dryer D through the inlet duct 40, the vent V through the outlet duct 50 and the water drainage system WD through the outflow tube 90. Preferably, the enclosure 20 is located at an elevation above the washer W and the water drainage system WD, such that gravity flow can evacuate the pool P within the enclosure 20. However, the enclosure 20 is preferably located no further above the washer W than a maximum elevation at which the washer W can pump used discharge water. Preferably, the enclosure 20 is located at a high elevation to prevent washer W from draining into the enclosure 20 when a pump of the washer is off. Locating the horizontal extension 62 above a highest level of water in the washer W ensures that such drainage will not occur.

Figure 5:
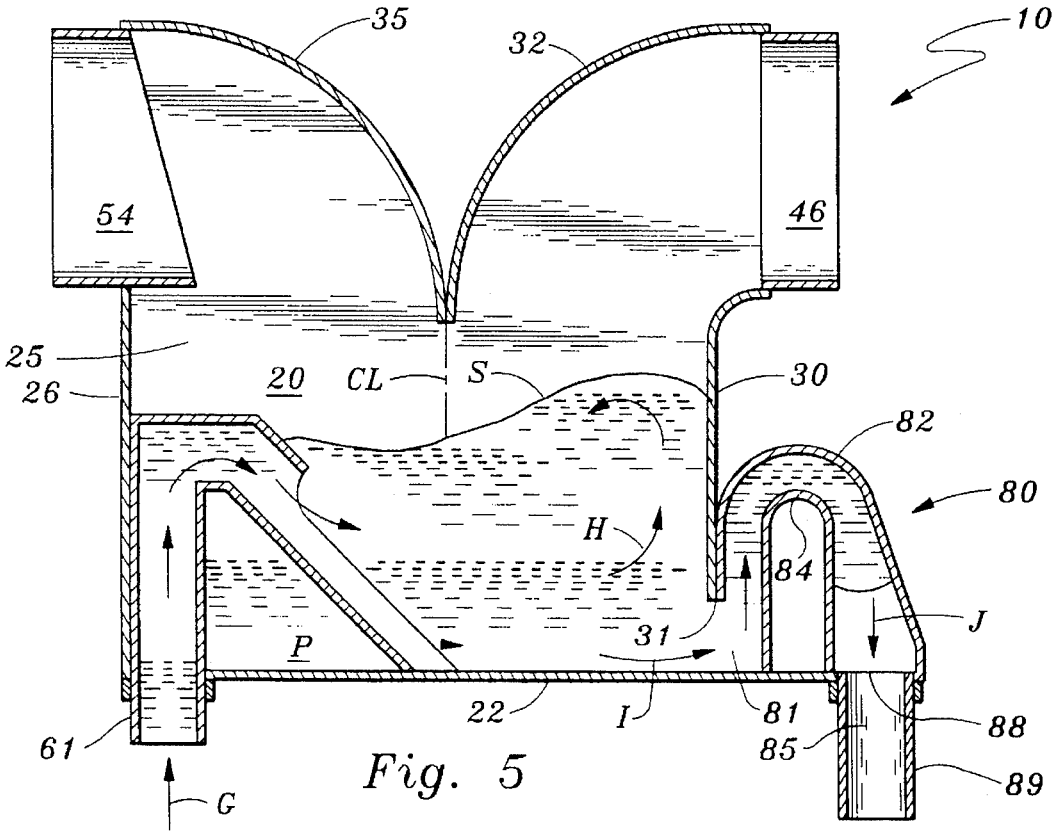
FIG. 5 is a full sectional front view revealing an intermediate phase of the dynamic mode of operation of the lint remover of this invention.
Figure 6:
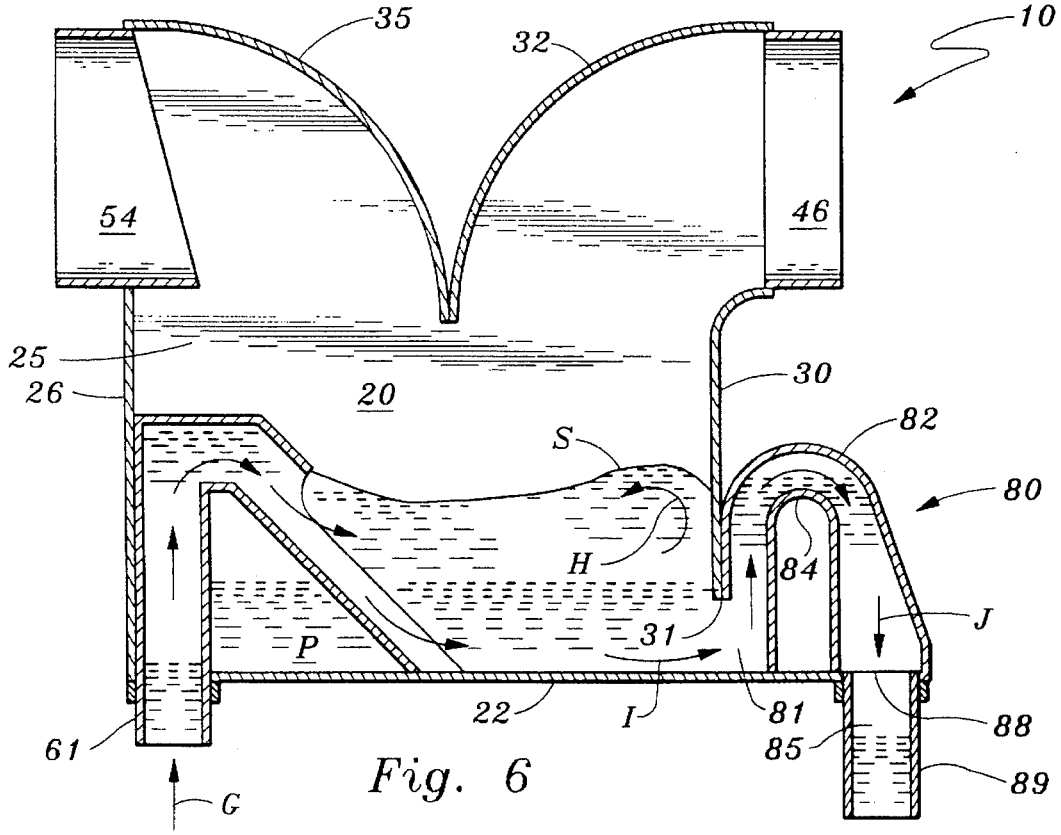
FIG. 6 is a full sectional front view revealing an equilibrium phase of the dynamic mode of operation of the lint remover of this invention.

When the washer W runs through its cycle, it periodically must drain a tub therein of used water. This water is pumped out of the washer W, through the inflow tube 60 and into the enclosure 20. When detergent laden used water is discharged from the washer W, the enclosure 20 experiences a cleansing wash. When rinsing water is discharged from the washer W, the enclosure 20 experiences a rinse. Thus, the lint remover 10 is effectively self-cleaning. Because the hump 84 is elevated above the floor 22, a pool P of water is formed within the enclosure 20. This pool P continues to increase in volume (FIG. 4) so that a surface S is spaced further and further above the floor 22 until the surface S is oriented above the hump 84. Water then begins to flow over the hump 84, creating a siphon and causing fluid to flow through the suction passage 80 by way of the entrance 81, hump 84 and exit 85 (FIG. 5). Once the water passes through the suction passage 80 with a sufficient flow rate, air is sufficiently driven out of the suction passage 80 to cause suction within the enclosure 20, and cause water within the enclosure 20 to be sucked through the suction passage 80 (FIG. 6).

Figure 3:
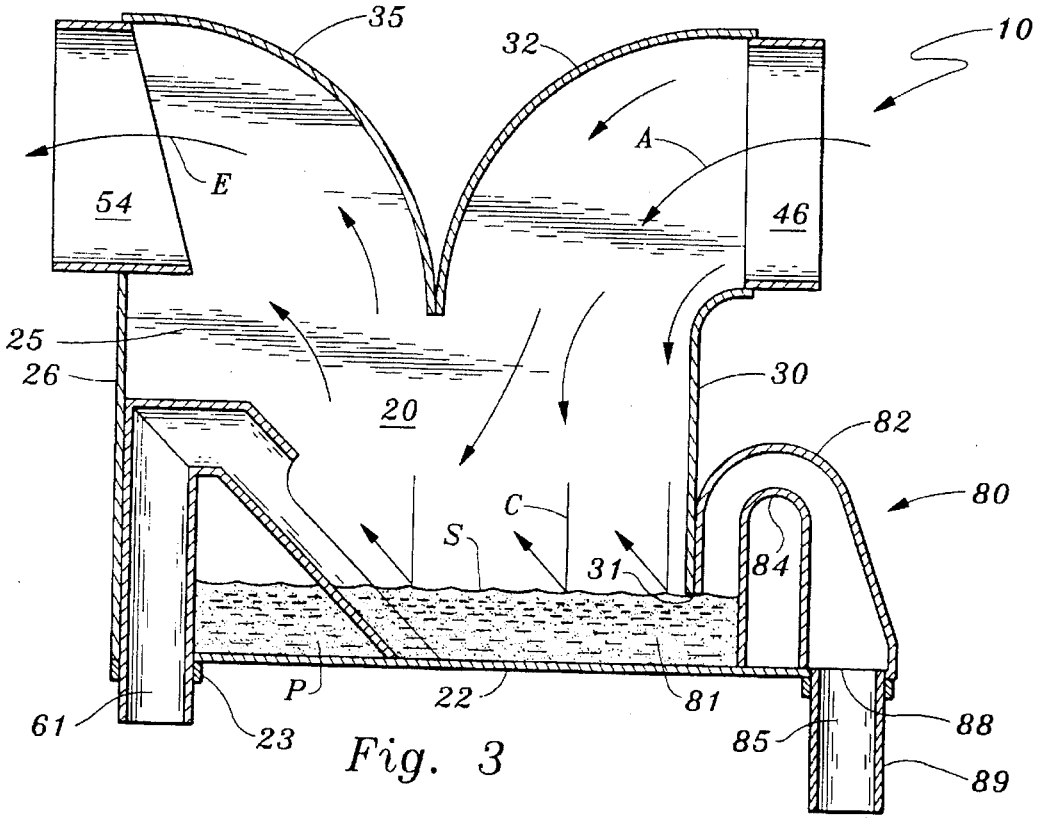
FIG. 3 is a full sectional front view of that which is shown in FIG. 2 revealing a static mode of operation of the lint remover of this invention.

When the washing machine W has completed its drainage of the washer W, water flow through the inflow tube 60 ceases. The surface S then begins to approach the floor 22 until it reaches a level approximately equal to a height of the lower end 31 of the second endwall 30. At this point, suction through the suction passage 80 and the siphon is broken and water ceases to flow out of the outflow tube 90 and into the water drainage system WD. The pool P of water is then provided in a static mode with the surface S adjacent the lower end 31 (FIG. 3). When the washer W again discharges used water, this cycle is repeated, during which a dynamic mode of the lint remover 10 is defined.

When a user begins to operate the dryer D, air is driven through the dryer D, and then through a dryer exhaust, through the inlet duct 40 and into the enclosure 20. The inlet vane 32 directs the exhaust air, along arrow A, in a downward direction toward the surface S. As the air is driven downwards, the air is caused to rebound off of the surface S, shown by arrow C, and be drawn through the outlet duct 50 along arrow E.

When the air is redirected by the surface S, lint particles entrained within the air, which have a greater mass than air molecules and hence greater momentum, are most likely to impact the surface S. When the lint particles contact the surface S, they have their surfaces wetted and are thus entrapped by the surface S of water within the pool P. The air flowing through the outlet duct 50, along arrow E, is hence substantially entirely removed of any lint particles therein.

Clothes washing machines W and clothes drying machines D are generally utilized in series, with the washer W utilized first and the dryer D utilized second. However, this is not always the case. This lint remover 10 anticipates a wide variety of washer W and dryer D use sequences. The lint remover 10, once initially charged by the washing cycle of the machine, is always provided in a condition ready to function to eliminate lint from the dryer D exhaust.

If the washer W and dryer D are utilized in series, the washer W completes its cycle with the pool P provided with water as shown in FIG. 3. The dryer D is then operated and lint in the exhaust air is entrained within the water within the pool P. When the washer W is later utilized, the water within the enclosure 20 is removed therefrom through the suction passage 80 and outflow tube 90 and replacement water is supplied within the pool P. This serial use of the washer W and dryer D can continue indefinitely.

Often, the washer W and dryer D are utilized simultaneously. When this occurs, the enclosure 20 of the lint remover 10 is always supplied with water within the pool P for entraining of lint therein. When the lint remover 10 is in its static mode (FIG. 3), the pool P is available to entrain the dryer D exhaust lint. When the lint remover 10 is in its dynamic mode (FIG. 4), the pool P is also available to entrain the dryer D exhaust lint. Thus, no downtime is endured and the dryer D can be utilized at any time regardless of the mode in which the lint remover 10 is currently functioning. Because of the clearance CL which exists between a lowermost "nadir" portion 34 and the highest liquid level (e.g. FIG. 5), the device is always ready to operate.

Figure 4:
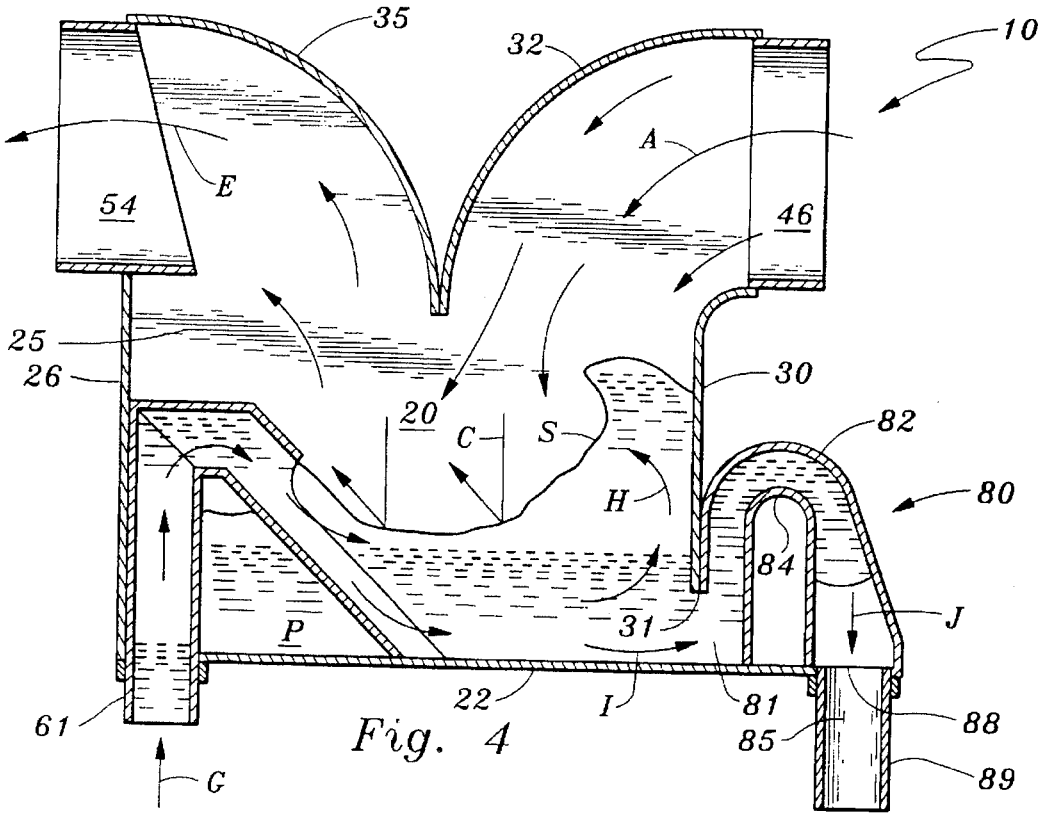
FIG. 4 is a full sectional front view similar to that which is shown in FIG. 3 and revealing an initial phase of a dynamic mode of operation of the lint remover of this invention.

As shown in FIG. 4, the water entering the enclosure 20 through the inflow tube 60 tends to exit through the trough 70 and then impact against the second endwall 30 and splash upwards toward the inlet vane 32. Simultaneously, a portion of the flow out of the inflow tube 60 passes along arrow I and directly into the suction passage 80 and thence along arrow J and into the outflow tube 90. This splashing of water within the pool P such as evidenced by arrow H, tends to cleanse the endwalls 26, 30 and sidewalls 24, 25, further removing lint from within the enclosure 20. This flow at arrow H also tends to increase an elevation of the pool P adjacent the suction passage 80, hence enhancing a suction action through the suction passage 80.

Figure 7:
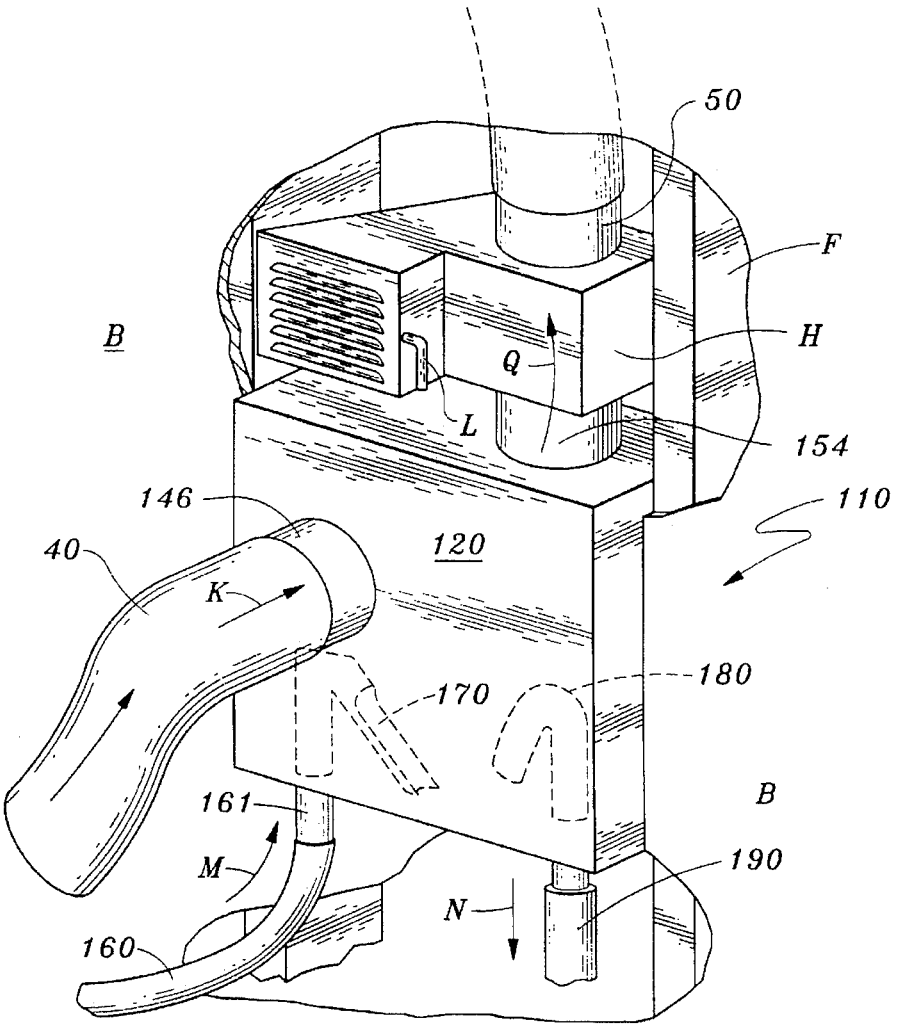
FIG. 7 is an alternative embodiment of that which is shown in FIGS. 1 through 6 revealing a lint remover incorporated into a wall of a residential structure adjacent the washing machine and the clothes drying machine.
Figure 8:
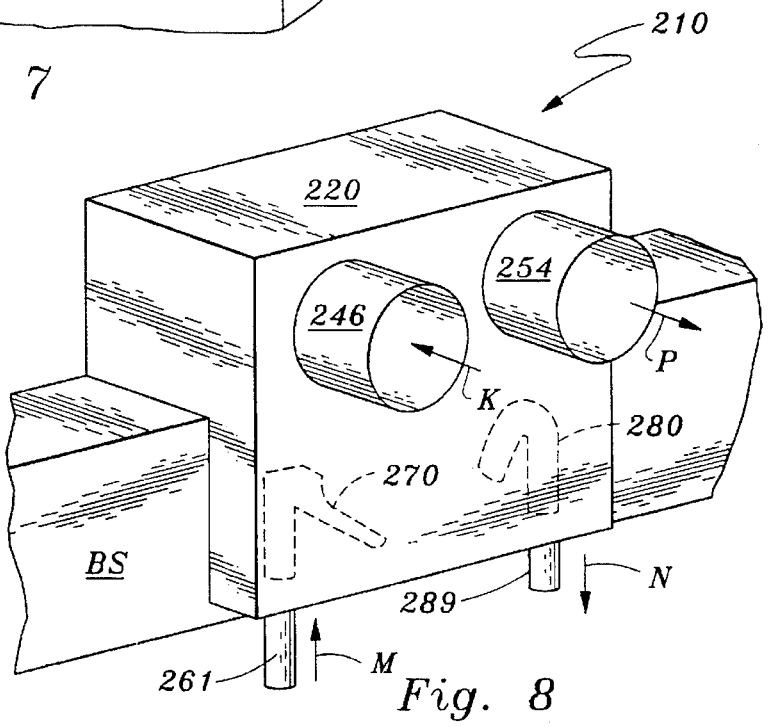
FIG. 8 is an alternative embodiment of that which is shown in FIGS. 1 through 6 which incorporates the enclosure of this invention into a backsplash of either a washer or a dryer.

With reference now to FIGS. 7 and 8, details of alternative embodiments of the lint remover 10 are described in detail. FIG. 7 reveals a lint remover 110 which is similar to the lint remover 10 except that it is framed into a wall of a residential structure. Vertical frame studs F are generally existing in many residential structures which are then covered by wallboard B. An enclosure 120 having a width similar to a distance between adjacent frame studs F is located between two frame studs F at a location at which a washer and dryer are to be utilized. An inflow tube 160 is provided directing water or other liquid along arrow M to a vertical extension 161 which discharges the liquid through a trough 170 within the enclosure 120.

A suction passage 180 is provides a liquid exit from the enclosure 120 through an outflow tube 190, along arrow N. The suction passage 180 can be in the form of a simple upside down U-shaped tube, with an uppermost portion thereof below the highest point on the pathway of fluid exiting the inflow tube 160.

The liquid can exit through the outflow tube 190. The enclosure 120 includes an inlet collar 146 extending out of a side thereof coupled to the inlet duct 40. Air exhaust flow from a dryer can pass through the inlet duct 40, along arrow K, and into the enclosure 20 for removal of lint entrained therein. The outlet duct 50 can extend out of a sleeve 154 extending from a top of the enclosure 120.

In some climates, it is desirable to include a heater H which allows for diversion of exhaust air from the outlet duct 50 and back into the residence. Lint-free airflow, along arrow Q, can be diverted by reorienting lever L such that the exhaust air is prevented from passing through the outlet duct 50 and instead is passed into the residence through a vent on a forward side of the heater H.

In another form of the invention, shown in FIG. 8, lint remover 210 is provided incorporated into a backsplash BS of either a washer or a dryer. An enclosure 220 is provided similar to the enclosure 20 of the preferred embodiment with an inlet collar 246 and an outlet sleeve 254 which receive exhaust air from a dryer, along arrow K, and discharge the air after the lint is removed, along arrow P. Water is provided from a washer, along arrow M, and through a vertical extension 61, out of a trough 270 and into the enclosure 220. When the water is to be removed from within the enclosure 20, a suction passage 280 coupled to a discharge cylinder 289 discharges the liquid, along arrow N, and out of the enclosure 220.

If the backsplash BS is coupled to a washer, the vertical extension 61 is preferably coupled to a used water discharge tube incorporated within the washer itself. If the backsplash BS is associated with a dryer, the inlet sleeve 254 is preferably directly coupled to the air exhaust of the dryer. By incorporating the lint remover 210 directly into a backsplash BS of a washer or dryer, an amount of plumbing and ducting related to lint remover 10 installation can be decreased.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. An apparatus for washing lint from a clothes drying machine air exhaust, comprising in combination:

an enclosure, a liquid inflow tube having coupling means for receiving liquid from a waste water line of a washing machine and coupled to said enclosure such that waste water from the washing machine passes through said apparatus en route to a drain, an air inlet duct including means to connect to a lint laden clothes drying machine air exhaust and coupled to said enclosure, said enclosure also including an air outlet duct and a liquid outflow drain tube having means coupled directly to a waste water drain, said liquid outflow drain tube having siphon means oriented in fluid communication with said liquid inflow tube and a pool interposed between said siphon means and said liquid inflow tube such that a pool of liquid is provided within said enclosure, said pool of liquid oriented proximate to said air inlet duct, such that lint entrained within air from said air inlet duct and into said enclosure is brought into contact with said pool of liquid, removing lint therefrom prior to said air outlet duct.

2. The apparatus of claim 1 wherein said enclosure includes an inlet vane adjacent said air inlet duct connecting means, said vane including means to direct air exhaust passing into said enclosure toward said pool of liquid.

3. The apparatus of claim 2 wherein said siphon means of outflow tube includes means to generate suction through said outflow tube.

4. The apparatus of claim 3 wherein said outflow tube includes a highest portion oriented below a highest portion of said inflow tube within said enclosure, whereby liquid outflow through said outflow tube will occur before liquid outflow through said inflow tube and flow reversal is prevented.

5. The apparatus of claim 4 wherein said outflow tube includes an entrance, a hump and an exit, said entrance and said exit both oriented below said hump, said outflow tube having a width similar to a width of said enclosure at said entrance and at said hump, and said outflow tube narrowing so as to funnel waste water into a tube at said exit.

6. The apparatus of claim 4 wherein said floor is oriented between a first endwall and a second endwall, said liquid outflow tube coupled to said enclosure through an entrance passing through said second endwall, said inflow tube having an outlet oriented to discharge liquid toward said entrance, whereby a current of liquid is generated flowing from said inflow tube to said outflow tube.

7. The apparatus of claim 4 wherein said inflow tube is coupled to a used water outlet of a clothes washing machine, whereby water exiting a clothes washing machine can be utilized to clean lint from a clothes dryer air exhaust.

8. The apparatus of claim 7 wherein said enclosure is framed into walls of a structure adjacent a clothes washing machine and clothes drying machine.

9. The apparatus of claim 7 wherein said apparatus is incorporated into a closed washing machine.

10. The apparatus of claim 7 wherein said apparatus is incorporated into a clothes drying machine.

11. A method for removing lint from a clothes dryer air exhaust, including the steps of:

scavenging dryer air from a clothes dryer exhaust including lint entrained therein, providing a liquid from washing machine waste water to receive all water from a washing machine, directing the dryer air against the liquid to entrain the lint within the liquid, and providing an outflow in fluid communication with the liquid to flush the liquid and lint entrained in the liquid directly into a drain.

12. The method of claim 11 including the further step of providing an inflow in fluid communication with the liquid, and supplying said inflow with used water discharged from a clothes washing machine.

13. The method of claim 12 including the further step of providing an enclosure including a floor supporting the surface of liquid thereon, the enclosure including means to receive liquid from the inflow, means to release liquid through the outflow, an inlet duct directing dryer air into the enclosure and against the liquid and an outlet duct for exit of dryer air out of the enclosure.

14. The method of claim 13 including the further step of siphoning the liquid through the outflow by orienting the outflow below a hump downstream from said outflow and above an exit downstream from said hump.

15. A clothes washing system comprising in combination:

a clothes washing machine including means to wash clothes with water and a used waste water outlet, a clothes drying machine including means to dry clothes with air and an air exhaust, and an air exhaust lint removal system including an air inlet having a coupling means to receive the air exhaust from said clothes drying machine, and an air outlet for releasing air to the environment, a water inflow tube including coupling means to receive all the used waste water from the used water outlet of said clothes washing machine including a water outflow to output the water and lint into a liquid waste system, wherein a pool of liquid having a surface is interposed between said water inflow tube and said water outflow, said surface oriented adjacent said air inlet, such that air from said air exhaust of said clothes drying machine is oriented to contact said pool of liquid and caused to deposit lint within said liquid, wherein said water outflow includes a siphon means to generate suction, such that liquid within said enclosure can only be removed out of said enclosure by siphoning, wherein said water inflow tube is oriented at an elevation above a highest point of said siphon means, whereby water within said enclosure passes through said water outflow before reaching a sufficient elevation to flow out of said enclosure through said inflow tube, and a siphon break located below said highest point to prevent total drainage of said pool.

16. The system of claim 15 wherein a pool of liquid having a surface is interposed between said water inflow tube and said water outflow, said surface oriented adjacent said air inlet, such that air from said air exhaust of said clothes drying machine is oriented adjacent said surface and caused to deposit lint within said liquid at said surface.

17. The system of claim 15 wherein said surface is oriented within an enclosure supporting said air inlet, said air outlet, said water inflow tube and said water outflow, said enclosure including a floor supporting said pool thereon.

18. The system of claim 17 wherein said enclosure includes an inlet vane therein adjacent said air inlet, said vane oriented to direct said air exhaust passing through said inlet downward at a location overlying said surface.

19. The system of claim 18 wherein said outflow includes means to generate suction, such that liquid within said enclosure can be suctioned out of said enclosure.

20. The system of claim 19 wherein said water inflow tube is oriented at an elevation above said outflow, whereby water within said enclosure passes through said outflow before reaching a sufficient elevation to flow out of said enclosure through said inflow tube.

21. A lint trap for a clothes dryer to remove entrained lint from exhausted air of the clothes dryer, comprising, in combination:

an enclosure having a liquid inlet adapted to be coupled to waste water of a clothes washer, an air inlet from exhaust gases of the clothes dryer and coupled to said enclosure, an air outlet coupled to said enclosure and in fluid communication with said air inlet, a liquid outlet coupled to a drain at one end and to said enclosure at another end, said liquid outlet in fluid communication with said liquid inlet, and a siphon means interposed between said liquid outlet and an interior of said enclosure, said siphon means including an inverted "U" shaped passageway including a hump located above a lowermost floor of said enclosure and below a free end of said liquid inlet to encourage storage of waste water in said enclosure up to said hump, whereby added waste water from said liquid inlet establishes a siphon over said hump until air enters into said "U" shaped passageway.

22. The trap of claim 21 further including a barrier wall projecting into said enclosure between said siphon and said inlet, said barrier wall (31) having a lowest edge extending below said hump to reduce an amount of waste water stored in said enclosure to a level coincident with said lowest edge so as to break any siphon formed with any waste water liquid added from the clothes washer.

* * * * *